US007562627B2

(12) United States Patent
Voigt

(10) Patent No.: US 7,562,627 B2
(45) Date of Patent: Jul. 21, 2009

(54) PYROTECHNICAL SYSTEM, PYROTECHNICAL OBJECT AND BURN OFF METHOD

(76) Inventor: Andreas Voigt, Kirchgasse 3, Marienberg-Kuehnhaide (DE) D-09496

( * ) Notice: Subject to any disclaimer, the term of this patent is extended or adjusted under 35 U.S.C. 154(b) by 20 days.

(21) Appl. No.: 10/564,859

(22) PCT Filed: Jun. 9, 2004

(86) PCT No.: PCT/DE2004/001174

§ 371 (c)(1),
(2), (4) Date: Jan. 12, 2006

(87) PCT Pub. No.: WO2005/008168

PCT Pub. Date: Jan. 27, 2005

(65) Prior Publication Data

US 2006/0207462 A1 Sep. 21, 2006

(30) Foreign Application Priority Data

Jul. 15, 2003 (DE) ..... 203 10 900 U

(51) Int. Cl.
*F42B 4/14* (2006.01)

(52) U.S. Cl. ..... 102/342; 102/217; 86/20.1

(58) Field of Classification Search ..... 102/342–345, 102/357, 358, 361, 275.1, 275.4, 335, 217; 86/20.1

See application file for complete search history.

(56) References Cited

U.S. PATENT DOCUMENTS 429,597 A * 6/1890 Bickford-Smith ..... 102/275.6
429,598 A * 6/1890 Bickford-Smith ..... 102/275.6
981,073 A * 1/1911 Dowd ..... 102/275.6
3,559,325 A * 2/1971 Webster ..... 42/55
3,706,277 A * 12/1972 Willard et al. ..... 102/275.4
4,052,940 A * 10/1977 Gits et al. ..... 102/361
4,314,508 A * 2/1982 Love ..... 102/275.7
4,714,017 A * 12/1987 Kelly et al. ..... 102/275.3
5,429,053 A * 7/1995 Walker ..... 102/342
6,393,990 B1 5/2002 Fagan
6,499,405 B1 * 12/2002 Ambrico ..... 102/275.7
6,561,102 B1 * 5/2003 Wang ..... 102/358

(Continued)

FOREIGN PATENT DOCUMENTS

CH 71 820 2/1916

(Continued)

*Primary Examiner*—Michael Carone
*Assistant Examiner*—Benjamin P Lee
(74) *Attorney, Agent, or Firm*—Jordan and Hamburg LLP

(57) ABSTRACT

The present invention relates to a pyrotechnic system, system-compatible pyrotechnic objects, and a firing method tailored to the system. The system comprises a starting device having multiple receptacles, having a connection channel between each of the receptacles. The receptacles are filled with the pyrotechnic objects, the first receptacle is provided with an additional ignition device, and the pyrotechnic object located therein is ignited. An igniter externally positioned on the pyrotechnic object conducts the ignition energy into the interior and simultaneously via the connection channel into the neighboring receptacle. A pyrotechnic object located therein is ignited. The igniter externally positioned on the pyrotechnic object partially causes a time delay. The delay time may be set by twisting the pyrotechnic object in relation to the connection channel. The choreography of fireworks may be designed through the combination of a starting device with selected pyrotechnic objects in connection with the setting of the delay time.

35 Claims, 4 Drawing Sheets

U.S. PATENT DOCUMENTS

| | | | | |
|---|---|---|---|---|
| 6,622,630 | B2 * | 9/2003 | Yang et al. | 102/275.4 |
| 7,007,584 | B2 * | 3/2006 | Caballer Barat | 89/1.816 |
| 7,100,512 | B2 * | 9/2006 | Monetti et al. | 102/275.12 |
| 2005/0257710 | A1 * | 11/2005 | Monetti et al. | 102/275.1 |

FOREIGN PATENT DOCUMENTS

| | | | |
|---|---|---|---|
| DE | 1 956 872 | | 6/1970 |
| DE | 24 04 870 | | 8/1975 |
| DE | 92 16 456 | | 2/1993 |
| DE | 198 44 528 | | 4/1999 |
| DE | 299 07 236 | | 8/2000 |
| DE | 694 25 924 | | 2/2001 |
| DE | 100 34 579 | | 3/2002 |
| FR | 2 715 998 | | 8/1995 |
| FR | 2759159 | A1 * | 8/1998 |
| WO | WO- 93/14365 | | 7/1993 |

* cited by examiner

PYROTECHNICAL SYSTEM, PYROTECHNICAL OBJECT AND BURN OFF METHOD

FIELD OF THE INVENTION

The present invention relates to a pyrotechnic system, system-compatible pyrotechnic objects, and a firing method tailored to the system.

BACKGROUND INFORMATION

Igniting multiple pyrotechnic objects one after another or possibly simultaneously is generally known.

In general, a construction is preferred in which a finite number of starting tubes are assembled into a packet, and the individual starting tubes are each connected to one another using ignition aids (ignition fuses) and filled with effect sets and/or discharge sets. These cake boxes or firework batteries are offered in prefinished implementations. The most significant disadvantage of this achievement of the object is the choreography and effect sequence predefined by the manufacturer, which may not be changed. Furthermore, it is known that the ignition system of such cake boxes is unreliable and in the event the ignition fuse working inside the firework is extinguished, the firework comes to a standstill. Furthermore, it is always possible that the firing procedure will start up again after going out, because of which safety is not ensured. In addition, it is disadvantageous that the cake box remains as a residue and is not reusable. A greater safety disadvantage of the cake box is that it fires off the effects in every position and attitude, even after falling over, being destroyed by premature explosions, or while upside down.

Professionally prepared fireworks regularly use starting devices to generate their own effect sequence instead of cake boxes, in which a finite number of starting tubes is first equipped with an ignition system made of multiple sections of ignition fuses and/or ignition cords, the discharge set is then poured in in the form of powder and finally the effect sets and possibly supplementary delay sets are then introduced.

This method requires a significant manufacturing outlay, since first the chronological sequence must be ensured via the ignition system through selection of the type and length of the ignition fuses, and ignition safety must be ensured simultaneously. When the starting tubes are filled with powder, individual starting tubes may be left out and/or filled multiple times, which may result in malfunctions of the sequence or even accidents. The powder used for the discharges may only be carried in limited quantities in vehicles, so that for large fireworks, the total quantity must be divided into multiple partial quantities and therefore onto multiple transport vehicles under certain circumstances, or hazardous material transports are necessary. In addition, such systems are not moisture resistant and therefore require additional protective measures in the event of corresponding weather conditions. Furthermore, the manifold available pyrotechnic objects, which require multiple different starting devices because of different dimensions and embodiments, are problematic. Such a device is unreliable because of the extensive use of ignition fuses. The ignition procedure may break down, and a partial or complete blowout is also possible. The desired choreography may thus sometimes not be achieved. Such types of fireworks may therefore only be prepared and ignited by qualified personnel. In spite of this, the reliability and safety remains inadequate and the costs are enormous.

According to a suggestion in French Patent Specification FR 2 715 998 A, the requirements for fireworks to be professionally prepared are to be met in that a starting device is used, comprising a base component and attachable starting tubes, which may be combined differently with one another. The ignition is performed via a slowly burning ignition fuse which lies in a central hole leading through all base components. According to a further suggestion, the ignition is also to occur with the aid of additional delay sets introduced into the continuous hole or electrically. A connecting opening is provided in each case between the continuous hole in the firing tubes, so that the burning ignition fuse is connected to the ignition fuses of the discharge sets and may ignite them.

The disadvantages of ignition with the aid of ignition fuses also exist in this invention. Simultaneously, maintaining a specific choreography via a special delay set is purchased by a significant material outlay.

The disadvantages described above in regard to the ignition safety are to be reduced by a divided ignition system according to a suggestion in DE 694 25 924 D2. The material outlay thus simultaneously rises enormously.

A possibility for firing multiple rockets simultaneously or at predefined time intervals one after another results through the use of a ring ignition fuse, as is described in German Utility Model DE G 92 16 456 U 1. In this case, a finite, limited number of bottle rockets is positioned in a collecting container and is fired simultaneously therefrom. The problems of the use of ignition fuses still exist. Choreography may not be achieved and combustion gases of a starting rocket overlay the ignition system, so that all rockets are fired simultaneously.

The requirement for a design of a specific choreography of a firework has been implemented according to a suggestion from European Patent EP 06 20 910. This relates to a starting device in which program-controlled pyrotechnic effects and/or objects are discharged and ignited through remote control, compressed air being used for their discharge. A low discharge height results from this. Increasing the quantity of air and/or the air pressure to increase the discharge height would result in significant secondary noises, which in turn interfere with the overall impression of the firework. The costs of this achievement of the object are significantly increased by the starting device used, the electronic controller required, and the tailored, remote-controlled pyrotechnic objects. Furthermore, this system is fixed at a location or transportable only with enormous outlay.

The present inventor has already suggested in German Utility Model DE 299 07 236 U1 that a number of rockets be started one after another by the first ignited rocket conducting a part of the combustion gases arising upon the start via a channel into a rocket lying ready in a neighboring holder and to its ignition fuse, through which it is ignited. However, this achievement of the object is also unsuitable for professionally organized fireworks. Rockets are always only to be obtained in a specific combination of effect sets. The flight path of rockets may practically not be predefined. This is also true for their flight height. Individually fixing the start intervals (ignition delay) is also not possible in this system, since this is already predefined by the construction of the rockets. Specific pyrotechnic effects, such as fire pots or comets, may also not be implemented using this system.

The overflow of hot combustion gases into channels is also known from delay sets, which are used in signal rockets, for example. Such delay sets are described in DE 19 56 872 B and DE 24 04 870 C2. However, their construction is enormously costly and use in pyrotechnic objects for fireworks is already precluded for this reason. Furthermore, the arrangements suggested in the above-mentioned documents are only suitable for functioning within a system of a signal rocket. The delay sets are an integral component of the pyrotechnic effect (of the rocket) and have no influence on its starting delay. The user has no possibility to decide on an individual ignition delay immediately before use.

The sequential ignition of multiple discharge loads through the combustion gases of the previously ignited discharge load using overflow channels is also known from the document CH 71 820 A. In this case, the preceding discharge set generates the evolution of heat required for the ignition and the next discharge set is immediately ignited. The overflow channels have no influence in regard to the chronological sequence and the ignition speed. In addition, the overflow channels must be filled with propellant charge, which is also shown in the drawing. The only thing that may be achieved using such an arrangement is that a specific number of discharge sets may be ignited almost simultaneously.

According to a suggestion in DE 198 44 528 A1, an ignition fuse is to be laid in a base, over which openings and, surrounding the openings, receptacles for pyrotechnic objects are positioned at fixed points. In this way, ignition of the pyrotechnic objects is to occur using an ignition fuse and its combustion energy via the openings in the base. This achievement of the object permits discharge tubes to be arrayed and to be ignited in sequence by the burning ignition fuse, but the ignition sequence is exclusively determined by the ignition fuse. The disadvantages described above from the use of an ignition fuse also exist here.

According to a suggestion in Japanese Utility Model Application JP 2001 021 295 A, the ignition of a pyrotechnic object may also be performed electrically. Producing a corresponding firework battery requires that electrical energy is available at the location of the ignition. Furthermore, a electrical or electronic control unit is required to activate the individual firing device.

According to a suggestion in U.S. Pat. No. 6,393,990 B1, it is also possible to implement individual components of firework batteries, each of which combines a number of firing tubes. The connection to one another is to be performed through dovetail guides. Furthermore, an electrical ignition system is suggested, for which additional connection elements must be provided. The same disadvantages exist here as described above.

According to a suggestion in DE 100 34 579 A1, a cake box is to be implemented in such a way that parts of the packaging are laterally moved by displacement and increase the support surface upon ignition. It is not ensured that the moved part remains in its position after folding out the packaging. Furthermore, fixing to the foundation is not possible according to the suggestion.

None of the achievements of the object described above may ensure termination of the ignition sequence in the event of ignition misfires. Furthermore, the starting devices may not be refilled immediately and a renewed starting procedure may not be initiated, if they are reusable at all.

OBJECT OF THE INVENTION

The present invention has the object of suggesting a pyrotechnic system which may be tailored easily and simply to the requirements of professional fireworks, operates using system-compatible pyrotechnic objects, may be tailored in wide ranges to the requirements of the fireworks to be organized and may be manufactured easily and simply and cost-effectively, fulfills all reliability and safety requirements, is location-independent, and in which the user is capable of establishing ignition intervals and/or choreography individually even shortly before use and of changing them again if needed without great complexity.

Furthermore, the present invention relates to a firing method for the pyrotechnic system.

DETAILS OF THE INVENTION

The details of the present invention result from the features of the patent claims, the description, and the exemplary embodiment. Exemplary embodiments and figures reproduce embodiments preferred on the date of application in this case and do not restrict the present invention.

The present invention first proceeds from the recognition that if appropriately designed pyrotechnic objects are used, continuous ignition of neighboring pyrotechnic objects is possible using combustion gases of an igniter. Furthermore, the present invention proceeds from the recognition that the quantities of powder used in loose form in professional fireworks are to be replaced by exactly measured quantities of powder and components of pyrotechnic objects prepared therewith. Missing discharge loads or overloads of starting tubes may thus be avoided. The parameters of such pyrotechnic objects may be established in narrow limits and may be mass-produced. Furthermore, such a prefinished pyrotechnic object may be produced having every technically possible effect set, possibly having additional delay sets, and in different sizes.

According to the present invention, firstly a system-compatible means for receiving the pyrotechnic objects according to the present invention is provided. This comprises at least one first receptacle and a second receptacle assigned thereto. The receptacles are dimensioned in such a way that they may receive the particular pyrotechnic objects and fix them corresponding to existing safety standards. They may also be implemented as starting tubes, as a firing channel, or provided with a starting rail.

In the simplest form, they are cylindrical receptacles of a height which approximately corresponds to the height of the pyrotechnic objects to be introduced. First and second receptacles are preferably permanently connected to one another. This may be performed through a material bond or through external, enveloping components.

The first receptacle has a lateral first opening, through which the ignition of the pyrotechnic object located in the receptacle occurs. A section of an ignition fuse is preferably used as the first igniter.

The first receptacle has transmission means for ignition energy in an elevated position, i.e., at a distance from the bottom surface thereof, which allows a part of the energy released upon the ignition of the pyrotechnic object located in the first receptacle to be conducted through this means into the second receptacle and ignite the pyrotechnic object located therein. The distance to be selected to the bottom surface of the receptacles is a function of the size of the pyrotechnic objects and the position of the igniter thereon and, in addition, of the necessity to ensure a safe footing in the receptacles until the ignition and/or firing. If system-compatible pyrotechnic objects having different heights are to be ignited from a receptacle, multiple transmission means may be positioned at different height levels.

The implementation of a hole or a channel is preferred for the transmission means, so that combustion gases may penetrate directly into the neighboring receptacle. As is shown below, the transmission means may be made from multiple individual parts.

In order to achieve multiple ignitions, a finite number of receptacles may be arrayed one on another, a first receptacle and then the required number of second receptacles being arrayed one on another in each case. It is also possible to combine multiple first receptacles with one another, since these differ from the second receptacles solely through the additional arrangement of a first opening for the first igniter. In such a case, the possibility also exists of igniting more than one sequence of pyrotechnic objects from a battery, the particular sequence being manually ignited by igniting the inserted ignition fuse.

There is also the possibility of providing a first or second receptacle with more than one transmission means, so that the pyrotechnic objects located in two or more receptacles may also be ignited by their ignition energy.

Professionally implemented fireworks require variable adaptations. A means for receiving pyrotechnic objects, in which a first receptacle is materially bonded to a number of first and/or second receptacles and this may then be combined, through means providing a form fit, with a further arrangement of the same type or an arrangement exclusively comprising second receptacles, is preferred according to the present invention. The corresponding fasteners may be molded from the same material or implemented by additional components, such as clamping frames, clamps, screw connections, and the like. It is thus possible to produce a nearly arbitrarily large battery of receptacles.

Manufacturing the individual arrangement/components through molding and simultaneously shaping the fasteners, through injection molding or metal casting, for example, is advantageous. The generally preferred embodiment of the components comprises an injection-molded part having tabs molded from the same material on the receptacles, these tabs implementing fasteners which are compatible in size and shape, preferably pins and holes.

The battery according to the present invention, comprising a number of individual arrangement/components for pyrotechnic objects, is preferably fixed on the foundation by additional elements, such as ground spikes, and may thus neither tip nor slip.

The pyrotechnic objects according to the present invention comprise units which contain at least one ignition set and one effect set. Depending on the requirements, such a pyrotechnic object may also be supplemented by a delay set, contain multiple effect sets, or even receive means which hold a fired effect set floating for a long time.

The component of a pyrotechnic object according to the present invention generally comprises a housing which is dimensionally compatible with the receptacles and preferably is made of environmentally friendly material, such as cardboard or paper. The housing is closed on all sides and receives the effect set in its upper part, while the ignition and/or discharge set is placed in the lower part. It is preferably made of easily combustible and/or decomposable materials, so that practically no residues remain after the ignition.

An igniter is externally applied to the housing at a distance from the bottom surface of the pyrotechnic object. The igniter is preferably attached at the same height as the transmission means for ignition energy provided in the receptacle. It is thus ensured that the ignition energy acts optimally on the igniter of the pyrotechnic objects.

The igniter applied to the housing of the pyrotechnic objects is provided over the entire circumference of the housing. Upon ignition, a flame front therefore runs around the housing. It is unimportant in this case whether such a housing is cylindrical or implemented having other cross-sectional shapes. The igniter applied to the housing comprises a material mixture which ignites with sufficient safety, whose combustion speed may be set in a wide range, generates sufficient evolution of heat for the ignition of the pyrotechnic objects, and additionally provides the energy excess required for igniting a further pyrotechnic object in neighboring receptacles. A mixture made of black powder, binders, and possibly additives which influence the combustion speed and/or evolution of heat and/or gas development of the mixture is preferred.

It has been shown that, as a function of the size of the housing and parameters of the igniter, combustion durations for half the circumference of the housing which allow a time interval $\geqq 0$ s are achievable. It is also possible to provide individual or multiple receptacles with objects which only have an igniter on the housing, but do not contain any pyrotechnic sets. Therefore, continuation of the ignition and a simultaneous multiplication of the time intervals may be achieved, the next pyrotechnic object only being positioned in a subsequent receptacle.

If the pyrotechnic object located in a first receptacle is ignited using a first igniter, i.e., an ignition fuse, first only the ignition coating applied externally to the housing ignites. Its flame front runs around the housing and reaches the transmission means to the neighboring second receptacle, so that the combustion gases penetrate into the second receptacle and ignite the igniter of a pyrotechnic object stored there. This procedure may be repeated arbitrarily often or continued, its sequence finally being limited by the number of receptacles connected to one another and the number of pyrotechnic objects stored therein. If no pyrotechnic object is located in a receptacle or its igniter does not ignite, the process comes to a stop. If the igniter of the pyrotechnic object ignites, but the object does not, the process is continued and the affected pyrotechnic object remains in its receptacle. In this case, only one effect does not enter the choreography. If the process of ignition comes to a stop, it is ensured that, unlike the ignition devices used until now, the ignition procedure does not revive. An unignited battery or an unignited pyrotechnic object may be emptied or removed without danger or a renewed ignition may be performed.

A continuation means, preferably an ignition fuse or an ignition cord, is positioned under the ignition coating on the housing of a pyrotechnic object, which conducts the ignition sparks to an ignition set in the interior of the housing. The continuation means may also be implemented as film strips having an applied igniter or as an ignitable coating inside the housing. If the ignition coating positioned externally on the housing is ignited, its burning also causes the ignition of the continuation means and the ignition of the ignition and/or discharge set via this means, a delay set able to be connected upstream thereof.

The position of the upper end of the continuation means in relation to the transmission device to the neighboring receptacle is decisive for the sequence of the ignition.

If the upper end of the continuation means lies directly at the entry of the transmission means, the continuation means is ignited together with the external igniter. If the pyrotechnic object is inserted in such a way that the upper end of the continuation means is twisted by an angle in relation to the entry opening of the transmission means, the continuation means is only ignited when the flame front of the external igniter has reached the upper end thereof. This possibility may particularly be used through intentionally twisted insertion of the pyrotechnic objects, rotational angles of 90° in 180° being preferred. A first time interval results if a pyrotechnic object is inserted twisted by 90°, this interval doubling at a twist angle of 180°.

Through combination of pyrotechnic objects having different combustion speeds of the external igniter with variable positions in regard to the rotational angle, different ignition intervals may be achieved, a noticeable minimum being at a few tenths of a second. Ignition intervals up to multiple seconds are also achievable.

The pyrotechnic object according to the present invention comprises a component which contains the necessary elements for ignition, possibly discharge, and the desired effects in a housing. The housing is in one piece and is preferably manufactured from pollutant-free and easily decomposable materials, such as cardboard or paper. The housing is preferably cup-shaped and the upper terminus is implemented as permanently sealed, while the lower terminus is implemented as thin-walled, through a paper or film layer, for example. As described above, an igniter is located externally on the housing at a distance from the bottom surface. This igniter is connected via an ignition fuse, ignition cord, ignition film, or ignition coating, which preferably runs inside the housing and only has a contact area to the external igniter, to a further pyrotechnic set. The lower end of the continuation means is connected either to a delay set or directly to the ignition and/or discharge set.

If the external igniter is ignited at any arbitrary point of the circumference of the housing, a flame front runs around the housing, the continuation means conducting the ignition into the interior of the pyrotechnic object to the appropriately connected set. Depending on the combination of the sets with one another, the pyrotechnic object is merely ignited and an effect near the ground (fountain) is displayed or the object is discharged and conveyed to a predefined height before the effect set ignites.

The pyrotechnic objects implemented in this way may be produced according to specific dimensional arrays and in specific set combinations. When performing fireworks, a correct selection may then be made in accordance with a choreography from the assortment provided.

A further embodiment of the pyrotechnic object according to the present invention comprises a two-part housing. The upper housing receives the effect set and possibly a delay set. The lower housing contains the ignition set and/or the discharge set and/or a delay set. Upper and lower housings have identical dimensions in their cross-section and may be glued abutting one another. The external igniter is preferably positioned on the lower housing, so that the continuation means may also already be introduced in the prepared lower parts.

One embodiment of these pyrotechnic objects uses a band, which runs around in the area of the seam, instead of or in addition to the adhesive bond. This has the advantage that the frictional force between upper and lower housing is increased and the discharge set may operate more effectively.

A further embodiment of the pyrotechnic object also uses a two-part housing, the upper housing being dimensioned in such a way that it fits in the lower housing. The continuation means may be inserted between both housings in this case, while the external igniter may be positioned in the transition area of both housing parts, for example, and may implement a fillet seam there.

Both embodiments described above offer the possibility of manufacture as prefinished components. However, it is also possible to offer both housing parts in prefinished form separately from one another, so that users may produce the required combination between effect and discharge sets themselves. The generally preferred embodiment of the three pyrotechnic objects described above is prefinished and has a moisture resistant external envelope. This comprises a material which only insignificantly increases the required ignition energy and through which combustion gases will penetrate without a time delay. This is also preferably a coating of a thin, easily combustible plastic film or a lacquering.

Pyrotechnic objects thus equipped may be offered in assembled form and users have the possibility of loading the receptacles corresponding to the requirements rapidly and producing the desired choreography of the fireworks through targeted selection and use of different pyrotechnic objects.

A further preferred embodiment uses an external inscription with the pyrotechnic objects described above, which indicates the position of the continuation means within the component and/or delay times achievable through twisting, so that the user may influence the choreography through targeted filling of the receptacles.

The firing method is that in a first work step, a component of the receptacle is placed and fixed on a foundation, such as the ground. The fixing may be performed using ground spikes.

In a previous work step, multiple units of the receptacle means may be combined with one another, either elements provided on the units ensuring the retention or additional elements being used for the clamping.

When the number of receptacles required for the intended fireworks has been achieved by combination of components and the overall arrangement is fixed, an ignition means, preferably an ignition fuse, is inserted in the first opening of the first receptacle. In a following work step, the first receptacle is filled with a pyrotechnic object, the time interval for the ignition thereof being determined by setting its rotational angle. This time interval has no significance for the choreography of the fireworks.

In a following work step, all receptacles following the first receptacle are each filled with the required and selected pyrotechnic objects. In this case, the time interval lying between two ignitions is determined by twisting and possibly by a prior selection of a specific type of the pyrotechnic object, the pyrotechnic objects slipping into the predefined position in the receptacles by being released.

A further work step is the ignition of the igniter positioned in the first receptacle in a known way.

In another embodiment of the firing method, pyrotechnic objects are generated through combination of effect sets and ignition sets and/or discharge sets in prior work steps.

In a further embodiment of the method, two firing processes which are independent from one another are performed within an arrangement of receptacles. This is possible, for example, in that one receptacle is not filled within the receptacles linked by transmission means, while the next filled receptacle is in turn externally ignited using a first igniter, i.e., an ignition fuse or ignition cord.

The pyrotechnic system according to the present invention has the advantage in particular that it uses a starting device which is permanent, usable arbitrarily often, arbitrarily expandable, and safe. Except for the first igniter, no auxiliary agents are needed for influencing the ignition procedure. The system-compatible pyrotechnic object may be implemented in the known breadth of variation with all effect sets and the necessary auxiliary agents, achieve the parameters required in professionally organized large-scale fireworks, and is reliable and safe. It may be prefinished and selected as needed. The firing method according to the present invention is so simple that workers may prepare a starting device in a short time. The starting device is light, may be disassembled, and may be stowed well in vehicles. The pyrotechnic objects may be assembled into large transport units, from which savings in cost result.

The pyrotechnic system is rapidly usable, independent of location, does not require any auxiliary energy, is weatherproof, and is environmentally friendly in its overall concept.

EXEMPLARY EMBODIMENTS

The present invention will be explained in greater detail in the following on the basis of 8 exemplary embodiments and 9 FIGS.

EXEMPLARY EMBODIMENT 1

Figure 1:
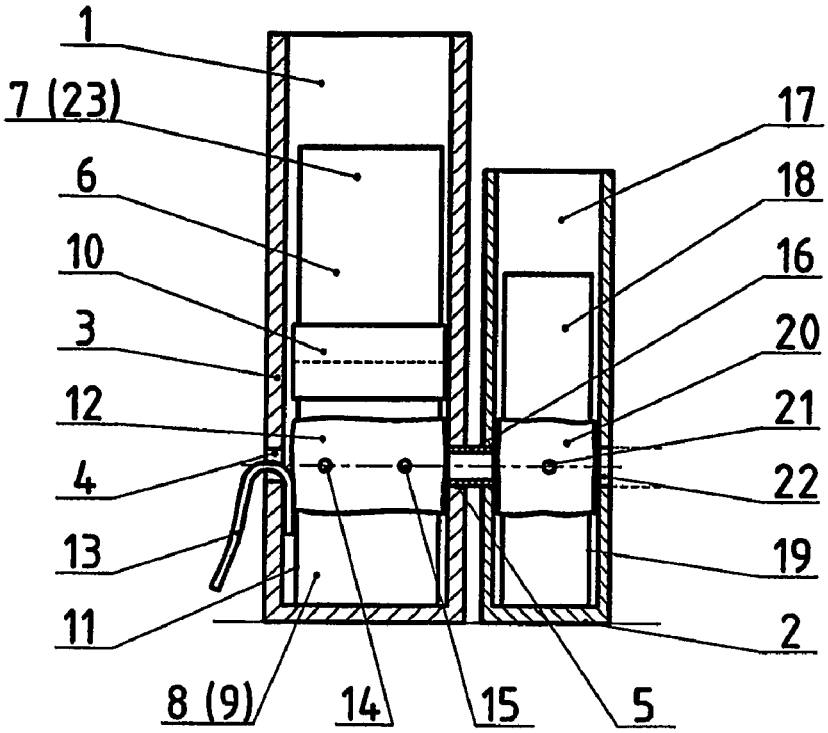
FIG. 1 is a cross-sectional view of a first embodiment of the invention.

The basic principle of the present invention is explained in this exemplary embodiment. A receptacle (1), which may also be implemented in an extended form as a firing channel, has its bottom surface (2) standing on a fixed foundation. A hole (4) is introduced peripherally into the wall (3) and a further hole (5) is introduced approximately diametrically opposite thereto.

A two-part pyrotechnic object and/or set (6) is located in the receptacle (1). This comprises an upper part (7), which contains the effect set, and the lower part (8), having the ignition and/or discharge part (9). Upper (7) and lower part (8) are connected to one another by a band (10).

The ignition and/or discharge part (9) has an ignitable strap (12) on its mantle (11), which was applied as a coating from a suspension. A section of an ignition line (13) is inserted into the receptacle (1) through the hole (4). The ignition and/or discharge part (9) has two penetration openings (14) and (15) in the area of the ignitable strap (12).

The hole (5) is provided with a sleeve (16) which leads into a further receptacle (17), which is equipped with a one-piece pyrotechnic object and/or set (18), for example. This also has an ignitable coating (20) on its mantle (19), at approximately the same height as the neighboring set. It also has a penetration opening (21) into the interior of the set. The receptacle (17) also has a further hole (22) diametrically opposite the hole (5).

After the ignition of the ignition line section (13), this burns up and the flame reaches the interior of the receptacle (1). There, it ignites the ignitable coating (12) of the pyrotechnic set and/or object (6), its flame front reaching the penetration openings (14, 15) in the interior of the pyrotechnic set and/or object (6) and igniting them. The ignition and/or discharge part (9) develops an internal pressure which explodes the band (10) and drives the effect set (23) to a predefined height.

The ignitable coating (20) simultaneously develops a flame front which surrounds the entire circumference of the pyrotechnic set and/or object and causes flames, sparks, or hot gases to reach into the hole (22), so that these reach the ignitable strap (20) of the pyrotechnic set and/or object (18) in the neighboring receptacle (17) (not shown) and also ignite it. Subsequently, the pyrotechnic set and/or object (18) (also not shown) is also ignited.

If still further receptacles and/or firing channels are connected via connection holes and/or overflow channels to the arrangement described, these may be ignited and fired in the same way.

EXEMPLARY EMBODIMENT 2

Figure 2:
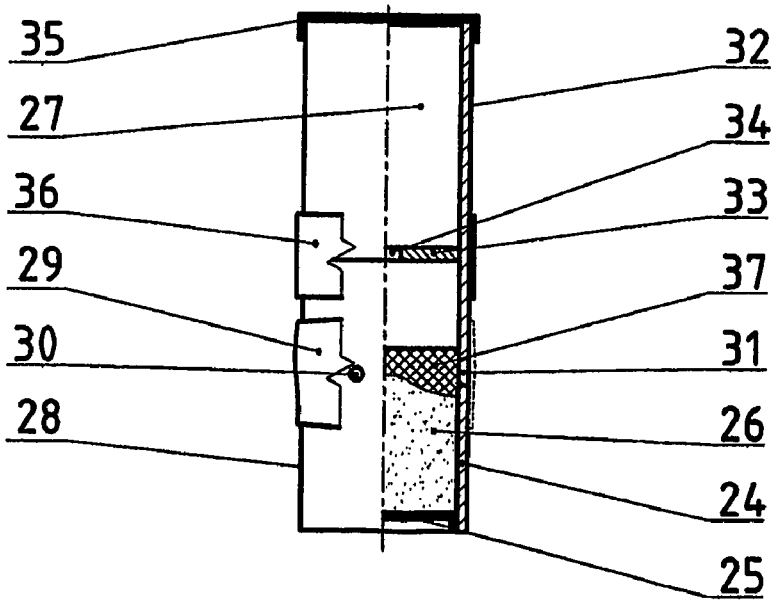
FIG. 2 is a view of a two-part pyrotechnic set and/or object according to a second embodiment of the invention.

The construction of a two-part pyrotechnic set and/or object is described in this exemplary embodiment and FIG. 2.

An ignition and/or discharge set comprises a sleeve (24) having a floor (25) and is filled with a powder charge (26). The quantity of powder is dimensioned according to the parameters of the effect set (27) and the required discharge height. The ignition and/or discharge set is provided around the circumference (28) with an ignitable coating (29), which was preferably applied as a suspension using an ignitable mixture. Flames may reach the interior of the ignition and/or discharge set via penetration openings (30) and (31) upon the ignition of the ignitable coating (29) and ignite the powder charge (26) located there.

The effect set (27) is prefinished as a bombette, has a housing having a mantle (32) and floor (33) and a floor-side opening (34). The upper terminus is generally a cover (35) made of an easily destructible material such as paper or film.

The filling of the effect set (27) is variable and corresponds to that of industrially manufactured bombettes.

The effect set (27) is connected to the ignition and/or discharge set by a band (36), which is easily destructible in case of ignition. Therefore, the effect set (27) may be discharged from a receptacle or firing channel and driven to a predefined flight height.

The ignition and/or discharge set may additionally be filled with a delay set (37) if necessary. If a greater time delay is to be necessary in the design of a firework, this may be achieved through the additional filling, since this burns at a predefined combustion speed and only then is the powder charge ignited.

The powder charge (26) also ignites the effect set (27) upon discharge via a connection hole (34).

EXEMPLARY EMBODIMENT 3

Figure 3:
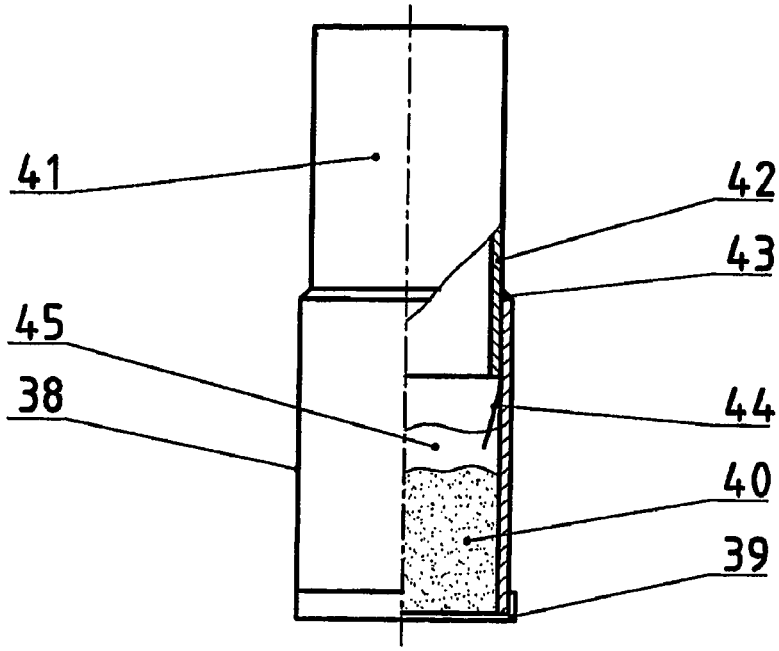
FIG. 3 is a view of a two-part pyrotechnic set and/or object according to a third embodiment of the invention.

The construction of a two-part pyrotechnic set or object is also described in this exemplary embodiment, with reference to FIG. 3.

An ignition or discharge set comprises a sleeve (38) having a floor (39) and is filled with a powder charge (40). In this case, the quantity of powder is dimensioned according to the parameters of the effect set (41) and the required discharge height.

The ignition and/or discharge set receives the effect set (41), the external diameter of the sleeve (42) of the effect set (41) approximately corresponding to the internal diameter of the sleeve (38) of the ignition and/or discharge set. The effect set (41) is therefore pushed into the sleeve (38). It may be fixed using suitable means, preferably through gluing, after being pushed in.

An ignitable coating (43) is applied in the transition area between sleeve (38) and sleeve (42), approximately in the form of a fillet seam. This ignitable coating (43) is approximately at the height of the transmission device described above from one receptacle to the next, so that combustion gases blowing through may ignite the ignitable coating (43).

A continuation means (44), which conducts the ignition energy from the ignitable coating (43) into the ignition and/or discharge set, is inserted between sleeve (38) and sleeve (42) and conducts the ignition energy inward. The continuation means (44) may be arbitrary, ignition fuses, ignition cords, or film strips having an ignitable coating preferably being used. In the upper area, the continuation means (44) has direct contact to the ignitable coating (43), while the lower end thereof is directly connected to means for ignition delay (45) or a powder charge (40), as required.

The effect set (41) is again preferably prefinished as a finished unit and may be combined with a fitting ignition and/or discharge set as required. The component assembled in this way may be combined into a finished component, using which the starting device may be loaded, as a function of effects to be selected, technical parameters, or on the basis of special customer wishes.

Sleeve (38), sleeve (42), and floor (39) are preferably produced from wound paper sleeves and/or paper which is destroyed upon burning of the particular pyrotechnic objects, which burns, or whose residues decompose in a short time if necessary. In particular, if the floor (39) is made of an easily combustible, thin material, it will be penetrated upon ignition of the ignition and/or discharge set and the sleeve (38) will typically be thrown out of the starting device.

The pyrotechnic object manufactured according to this exemplary embodiment has the advantage in particular that combustion gases of the ignitable coating (43) may escape upward through the smaller diameter of the sleeve (42) and the effect set (41) and the gap to the receptacle resulting therefrom. The pyrotechnic object is thus held in the receptacle and not already driven out by gases of the ignitable coating (43).

EXEMPLARY EMBODIMENT 4

Figure 4:
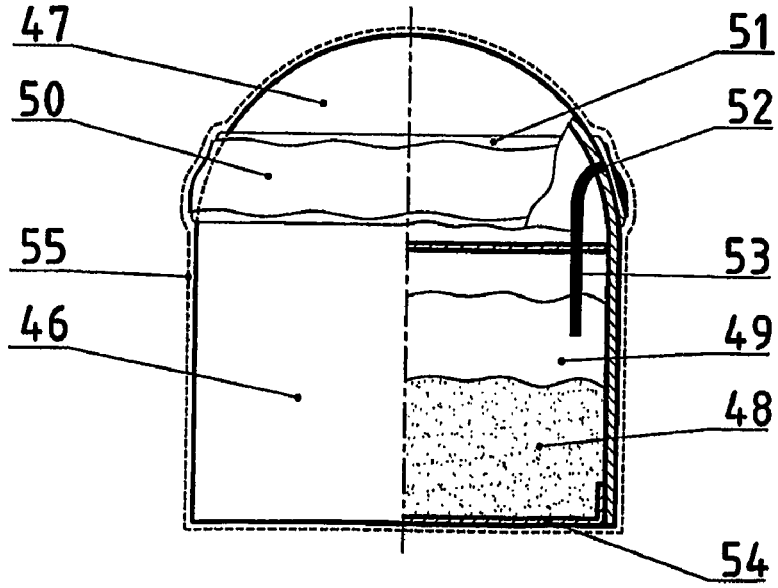
FIG. 4 is a view of a fourth embodiment of the invention.

In this exemplary embodiment, as depicted in FIG. 4, a form of the pyrotechnic objects which preferably comes into consideration in large calibers for use in professional fireworks is described.

A housing (46), which again preferably comprises a winding of an easily combustible and also easily decomposable material, such as paper, receives the effect set (47) in the upper part and the ignition and/or discharge set beneath it. The latter usually comprises a powder charge (48), which is also supplemented with a delay means (49) if necessary.

Approximately in the area of the transition from the cylindrical shape to the hemispherical shape, the housing (46) carries an ignition unit, here preferably an ignitable coating (50) or a self-adhesive support (51) which receives such a coating.

The ignition is conducted into the housing interior via an opening (52) in the housing (46) and conducted there by a continuation means (53) to the delay or ignition or discharge set.

Upon ignition of the ignition or discharge set, the floor (54) is simultaneously penetrated and the pyrotechnic object is discharged from the receptacle nearly without a residue.

The ignitable coating (50) is approximately at the same height as the transmission device between the receptacles, so that combustion gases which arise upon ignition of a pyrotechnic object in a neighboring receptacle may act directly on the ignitable coating (50), but the combustion gases of the ignition device may in turn be conducted using a transmission device to a neighboring receptacle and thus to the ignition device of a pyrotechnic object possibly located therein.

The housing and the ignition device are covered with a protective coating (55), a lacquer layer or a film coating preferably coming into consideration. The pyrotechnic objects thus equipped are therefore moisture resistant and may be used even in the event of unfavorable weather conditions without misfires occurring. The coating is selected in such a way that incident combustion gases may penetrate this layer without problems and the ignition device is ignited with high reliability.

EXEMPLARY EMBODIMENT 5

In this embodiment, a possibility is described for how the delay times between the ignitions of multiple pyrotechnic objects may be set easily.

The pyrotechnic objects described in exemplary embodiments 2 through 4 are preferably equipped in such a way that the continuation means (44), (53) or the penetration openings (14) or (15) which conduct the ignition energy into the interior of the housing are simply provided and positioned at a fixed position. The time interval between the ignitions of the ignitable coating (12), (29), or (50) and the ignition of the continuation means (44) or (53) or the powder charge (26) is thus also a function of the route which the combustion horizontal line has to cover. The material of the ignition devices may be varied in regard to the combustion speed, so that combustion times between approximately 1 ms and multiple seconds may be achieved in combination with the route provided. Further time delays may be achieved through the type of the continuation means (44) or (53) and through additional delay means (37) provided in the housing.

The position of the continuation means is visibly identified on the housing of the pyrotechnic objects according to the present invention. If the pyrotechnic object is inserted into the receptacle in such a way that the continuation means lies directly on the transmission device, a time delay only results due to the continuation means (44) or (53) and a possibly provided delay set (37). In contrast, if the same pyrotechnic object is inserted twisted by approximately 90°, the delay time of the ignitable coating (20), (29), (43), or (50) is added thereto.

If the same pyrotechnic object is inserted twisted by 180°, the complete delay time of the ignition device acts, since the combustion horizontal line must run around the housing.

In consideration of tolerances in the igniters used, if a maximum delay time at 180° position is used as a basis, at least half of this time at 90° and the delay time 0 at 0° may be set reliably. Setting the delay times is performed in this case through simple twisting during filling of the starting device, housing markings and/or markings on the starting device being helpful.

If the operating principle described above is used as a basis, and pyrotechnic objects having the desired pyrotechnic effects and ignition and/or discharge sets having specific delay intervals are selected simultaneously, a desired choreography of the fireworks may be achieved both in regard to visual effects and also in correspondence with music, for example. The breadth of variation extends in this case from the simultaneous firing of at least two neighboring pyrotechnic objects via firing at always identical time intervals up to variable time intervals in a range between approximately 0.1 seconds and multiple seconds.

EXEMPLARY EMBODIMENT 6

Figure 5:
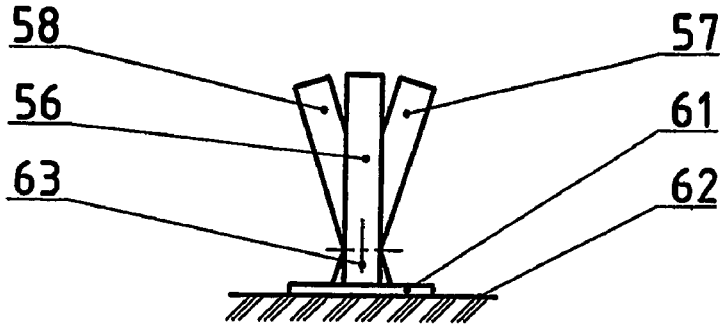
FIG. 5 is a view of a fifth embodiment of the invention.
Figure 6:
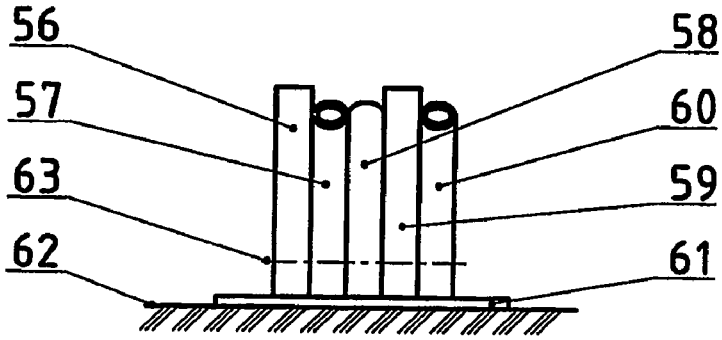
FIG. 6 is a view of a sixth embodiment of the invention.

An arrangement of receptacles and/or firing channels having different discharge directions is described in this exemplary embodiment and FIGS. 5 and 6.

A vertical receptacle (56) is connected to a receptacle (57) positioned slanting to the right and this in turn is connected to a receptacle (58) positioned slanting to the left. This is in turn followed by a vertical receptacle (59) and subsequently a receptacle (60) positioned slanting to the right. These are connected to a support surface (61), which in turn stands on a foundation (62).

The particular receptacles positioned next to one another are connected to one another using an overflow hole (not shown), whose position is marked by the dashed line (63). If one of the receptacles is equipped with a pyrotechnic object and/or set as described in exemplary embodiment 1, upon firing, the pyrotechnic object and/or set located therein ignites the object and/or set located in the neighboring receptacle and also fires it.

EXEMPLARY EMBODIMENT 7

Figure 7:
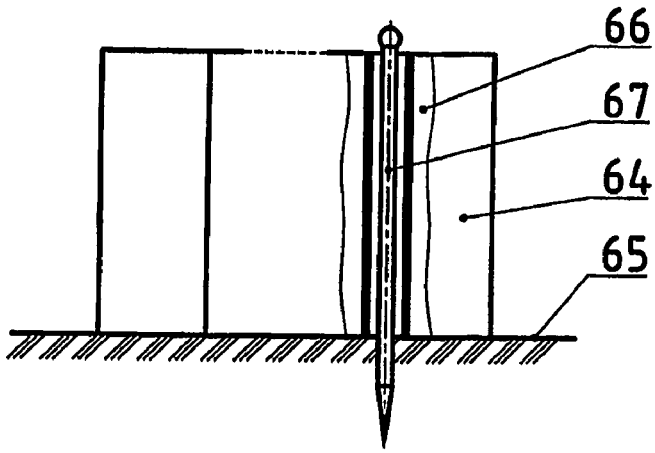
FIG. 7 is a view of a seventh embodiment of the invention.

Effective securing against intentional turning over or tilting over during the starting procedures for a battery of receptacles and/or firing channels is described in this exemplary embodiment. FIG. 7 shows this.

A finite, limited number of firing tubes is assembled into a packet (64) and the particular bottom surfaces of the receptacles stand on a foundation (65), preferably on the ground. As a function of the size of the packet (64), an opening (66) is provided between the receptacles in one or two axes, in each of which a fastener (67), preferably a ground spike, may be inserted or driven into the foundation. Therefore, knocking over the packet (64) through unintentional impact or through reaction forces during firing of the pyrotechnic objects and/or sets and/or objects or through vandalism is largely precluded.

EXEMPLARY EMBODIMENT 8

Figure 8:
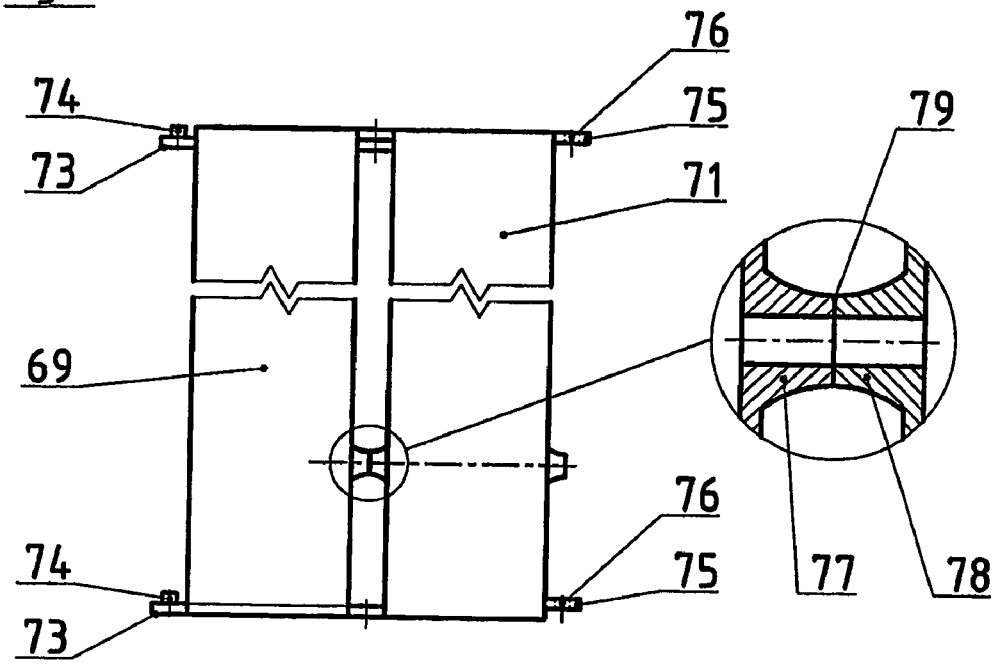
FIGS. 8 and 9 show a fourfold arrangement of an eight embodiment of the invention.
Figure 9:
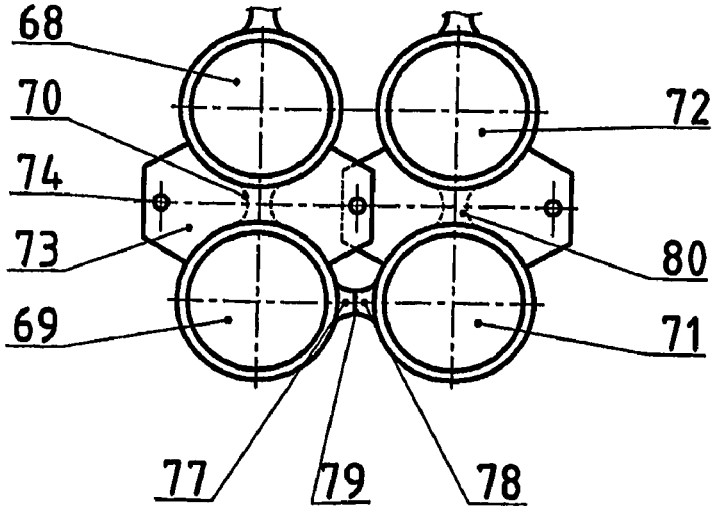

In this exemplary embodiment, a starting device according to the present invention is described, which may be constructed from individual modules and thus permits adaptation to requirements of fireworks to be organized. FIG. 8 and FIG. 9 merely show a fourfold arrangement in this case for exemplary purposes, the practical implementation permitting larger modules at any time.

A module, comprising a receptacle (68), a receptacle (69), and a connection (70) positioned between them, is connected to a further module, comprising the receptacle (71) and receptacle (72). A tab (73) is located at the upper end of the first module, from which a pin (74) is molded approximately in the middle. The tab (75) is positioned diametrically opposite thereto on the same module, which in turn has a hole (76) in the same position. An identical arrangement is provided on the lower end of the module.

The second module is constructed essentially identically, so that a connection may be produced between the first and second modules using the molded tabs. Receptacle (69) has a molded dome (77) laterally, which is connected to a dome (78) molded in a mirror image on receptacle (71).

The partition line (79) of the domes (77) and (78) may run linearly, but may also have profiling to increase the tightness of the contact surfaces. A permanent, indivisible connection (70) exists between receptacle (68) and receptacle (69) within the module. This is also true of the connection (80) between receptacle (71) and receptacle (72).

The connections (70) and (80) and the domes (77) and (78) receive the transmission devices described above, which are used to conduct the combustion gases from one receptacle to the next.

The arrangement described is preferably manufactured from plastic and modules having an even or odd number of receptacles are produced. Through assembly using the tabs (73) and (75), a multiple arrangement results, which allows starting devices having a fixed number of receptacles and in which the number of receptacles required for performing professional large-scale fireworks may be provided. The starting devices thus obtained may be transported either in the form of the individual modules or assembled, are very light, and allow interference-free ignition of fireworks even in the event of poor weather conditions.

If the receptacles (68), (69), (71), and (72) are each equipped with a pyrotechnic object, the pyrotechnic object located therein may be fired by introducing a first igniter into a hole of the receptacle (68). Through the connection (70), the combustion gases reach receptacle (69) and ignite the pyrotechnic object located therein, which in turn fires the pyrotechnic object located in receptacle (71) via the domes (77) and (78) and the connection thus resulting in this in turn fires the object located in the receptacle (72). If an array of multiple receptacles is provided, this procedure may be continued from the first up to the last receptacle.

The invention claimed is:

1. A pyrotechnic system, comprising:

a first igniter;

pyrotechnic objects each being provided in a form of a component, at least one of said pyrotechnic objects including at least one ignition set and at least one effect set, each said component including a second igniter on an external contour thereof;

reception structure for receiving the pyrotechnic objects including at least a first receptacle and a second receptacle for the pyrotechnic objects, said first and second receptacles each including a closed bottom and an open end opposite to said bottom through which said pyrotechnic objects are ejected when ignited, the first receptacle including a first opening through which said first igniter extends into an interior of said first receptacle, said first igniter being operable for igniting a respective one of the pyrotechnic objects located in the first receptacle after the ignition of the second igniter thereby;

a transmission device positioned between the first and the second receptacles, said transmission device being operable for conducting ignition energy sufficient to ignite the second igniter of the other respective one of the pyrotechnic objects from said first receptacle to said second receptacle, said transmission device being disposed in a position spaced apart from said bottom of each of said first and second receptacles and positioned between said bottom and said open end such that combustion energy is conducted via the transmission device to the second igniter of an other respective one of the pyrotechnic objects located in the second receptacle with a bottom of said other respective one of the pyrotechnic objects being located between the bottom of said second receptacle and said transmission device, thereby igniting the second igniter of the other respective one of the pyrotechnic objects; and a continuation structure which conducts the ignition energy of each second igniter to an interior of the component corresponding thereto, thereby igniting a respective one of the pyrotechnic objects.

2. The pyrotechnic system according to claim 1, wherein the ignition and effect sets ignite approximately simultaneously or sequentially.

3. The pyrotechnic system according to claim 1, wherein at least one of the first or the second receptacles is implemented as at least one of a bearing, a firing channel or a firing rail.

4. The pyrotechnic system according to claim 1, further comprising:

additional receptacles for receiving additional pyrotechnic objects being positioned downstream from the first receptacle; and at least one additional transmission device for conducting ignition energy being positioned between each of said additional receptacles and disposed in an elevated position from a bottom of each of said additional receptacles.

5. The pyrotechnic system according to claim 1, further comprising:

a number of additional receptacles for receiving additional pyrotechnic objects; and a corresponding number of transmission devices for conducting ignition energy from the first receptacle directly to the additional receptacles each being disposed in an elevated position from a bottom of each of said additional receptacles.

6. The pyrotechnic system according to claim 5, wherein first receptacle, said second receptacle and said additional receptacles are connected permanently to one another to form an integrated component.

7. The pyrotechnic system according to claim 6, wherein the component includes connection structure operable for connection to a further like integrated component carried on an external contour thereof.

8. The pyrotechnic system according to claim 7, wherein the connection structure includes positive and negative molded elements which are molded from a same material as the integrated components and which provide at least one of a form fit or a friction fit.

9. The pyrotechnic system according to claim 7, wherein the integrated components are assembled by connection elements providing a form fit.

10. The pyrotechnic system according to claim 7, wherein at least one of the additional receptacles provided in the integrated component is positionable for transmitting ignition energy to a receptacle of said further like integrated component connected in a form fitting manner.

11. The pyrotechnic system according to claim 7, wherein central axes of the receptacles are positioned at least one of parallel or at an angle $\alpha>0°$ to one another in longitudinal and transverse directions.

12. The pyrotechnic system according to claim 7, wherein an arrangement comprised of the integrated components is secured in relation to a placement surface by fixation elements against at least one of tipping over or slipping.

13. The pyrotechnic system according to claim 1, further comprising:

multiple additional receptacles for receiving additional pyrotechnic objects being positioned downstream from said second receptacle; and an additional transmission device for conducting ignition energy is positioned between each of said multiple additional receptacles and disposed in an elevated position from a bottom of each of said additional receptacles.

14. The pyrotechnic system according to claim 1, wherein the transmission device for conducting ignition energy includes a space lying above a base of each of the first and second receptacles which is nearly closed on all sides and which connects the first receptacle to the second receptacle or a second receptacle to an additional receptacle in such a way that the ignition energy may be conducted in sufficient energy density into a neighboring one of the receptacles and to a corresponding one of the pyrotechnic objects stored therein.

15. The pyrotechnic system according to claim 14, wherein the enclosed space is implemented as one of a channel, a hole or as an opening arising from multiple enveloping components.

16. The pyrotechnic system according to claim 1, wherein said component embodying a one of said pyrotechnic objects includes a discharge set.

17. The pyrotechnic system according to claim 16, wherein the component embodying said pyrotechnic object includes a floor which is at least one of destructible or burnable during at least one of ignition or discharge.

18. The pyrotechnic system according to claim 16, wherein said ignition energy is produced by combustion gases formed by at least one of said second igniter, said ignition set or said discharge set.

19. The pyrotechnic system according to claim 1, wherein said component embodying a one of said pyrotechnic objects includes a delay set.

20. The pyrotechnic system according to claim 1, wherein the second igniter on the external contour of the component is an easily ignitable agent which burns with sufficient heat generation.

21. The pyrotechnic system according to claim 20, wherein the easily ignitable agent includes a black powder coating burning with reduced combustion speed.

22. The pyrotechnic system according to claim 20, wherein the easily ignitable agent includes a coating having a combustion time $t \geqq 0.5$ s.

23. The pyrotechnic system according to claim 1, wherein the component embodying said pyrotechnic object is enclosed by an external film.

24. The pyrotechnic system according to claim 1, wherein the component includes a housing which is implemented in two parts, said two parts abutting one another and being at least one of glued to one another in a join area or connected to one another by an external adhesive strip or band.

25. The pyrotechnic system according to claim 1, wherein:

the component includes a housing which is in two parts;

one of the two parts of the housing receiving the discharge set is implemented larger than a remaining one of the two parts; and a remaining one of the two parts containing the effect set has a relatively smaller diameter and is positioned in the one of the two parts; and both housing parts are permanently connected to one another.

26. The pyrotechnic system according to claim 1, wherein:

said component includes a housing; and the second igniter on the external contour of the pyrotechnic object is positioned in an upper area of the housing.

27. The pyrotechnic system according to claim 26, wherein the second igniter is positioned in the upper end of the housing in a tapered diameter area.

28. The pyrotechnic system according to claim 1, wherein central axes of the receptacles are positioned at least one of parallel or at an angle $\alpha>0°$ to one another in longitudinal and transverse directions.

29. The pyrotechnic system according to claim 1, wherein said transmission device is sufficiently dimensioned to be operable for effectively conducting the ignition energy from said first receptacle to said second receptacle without requiring said transmission device to include a combustible material prior to ignition of said respective one of the pyrotechnic objects located in the first receptacle.

30. The pyrotechnic system according to claim 1, wherein said ignition energy is transmitted through said transmission device to the second receptacle without requiring any combustible material to be provided within the transmission device prior to the ignition of the second igniter.

31. A firing method for pyrotechnic systems, comprising:

providing receptacles for receiving pyrotechnic objects, each of said receptacles including a closed bottom and an open end opposite to said bottom through which said pyrotechnic objects are ejected when ignited;

equipping said receptacles with a number of said pyrotechnic objects corresponding to the number of receptacles provided, a first of said receptacles having an opening and being equipped in the opening with an igniter, said pyrotechnic objects each including a second igniter on a housing thereof;

placing and fastening an arrangement of said receptacles at a usage location;

igniting the igniter such that the second igniter of a one of the pyrotechnic objects located in the first of said receptacles is ignited thereby;

transmitting combustion energy generated by ignition of the second igniter to a second of the receptacles through a transmission device located at a position spaced apart from the bottom of each of the receptacles and positioned between said closed bottom and said open end so as to ignite the second igniter of a corresponding one of the pyrotechnic objects located therein with a bottom of said corresponding one of the pyrotechnic objects being located between the bottom of said second of the receptacles and said transmission device;

further transmitting combustion energy to other ones of the receptacles to effect subsequent ignition of pyrotechnic objects located therein; and continuing ignition energy of each second igniter to an interior of the housing of a corresponding one of the pyrotechnic objects such that subsequently the ones of the pyrotechnic objects located in other ones of the receptacles connected to the first of the receptacles are at least one of ignited or discharged.

32. The firing method for pyrotechnic systems according to claim 31, further comprising twisting the pyrotechnic objects as they are inserted into the receptacles, so that the ignition thereof occurs immediately or after a time interval determined by the burning time of the igniter as a function of an angle created by the twisting.

33. A firing method for a pyrotechnic system according to claim 31, further comprising:

connecting a first one of modules, comprising the first receptacles and a finite number of other ones of the receptacles, in a form-fitting manner to one or more remaining modules; and implementing a connection for transmitting ignition energy between a last one of the receptacles of the first one of the modules and a particular first receptacle of the following one of the modules in each case between the first module and the further modules.

34. The firing method for a pyrotechnic system according to claim 31, further comprising locking said receptacles on a foundation or a placement surface.

35. The pyrotechnic system according to claim 31, wherein said transmitting of combustion energy is carried out without requiring any combustible material to be provided within the transmission device prior to said igniting of the igniter.

* * * * *